US011109681B2

(12) United States Patent
Zhang et al.

(10) Patent No.: US 11,109,681 B2
(45) Date of Patent: Sep. 7, 2021

(54) SELF-LOCKING MECHANISM AND LIFT CHAIR THEREWITH

(71) Applicant: Changzhou Zehui Machinery Co., Ltd, Jiangsu (CN)

(72) Inventors: Zhixing Zhang, Jiangsu (CN); Liming Zhu, Jiangsu (CN)

(73) Assignee: Changzhou Zehui Machinery Co., Ltd, Jiangsu (CN)

( * ) Notice: Subject to any disclaimer, the term of this patent is extended or adjusted under 35 U.S.C. 154(b) by 0 days.

(21) Appl. No.: 16/993,467

(22) Filed: Aug. 14, 2020

(65) Prior Publication Data

US 2021/0196047 A1 Jul. 1, 2021

(30) Foreign Application Priority Data

Dec. 30, 2019 (CN) ..... 201911392482.9
Dec. 30, 2019 (CN) ..... 201922451035.8

(51) Int. Cl.

| | |
|---|---|
| ***A47C 1/035*** | (2006.01) |
| ***A61G 5/14*** | (2006.01) |
| ***A47C 3/20*** | (2006.01) |
| *A47C 1/0355* | (2013.01) |

(52) U.S. Cl.
CPC ..... *A47C 3/20* (2013.01); *A61G 5/14* (2013.01); *A47C 1/0355* (2013.01)

(58) Field of Classification Search
CPC ..... A47C 1/0355; A47C 3/20; A61G 5/14
USPC ..... 297/68–87, 330, DIG. 10
See application file for complete search history.

(56) References Cited

U.S. PATENT DOCUMENTS

| | | | | |
|---|---|---|---|---|
| 3,582,135 A * | 6/1971 | Fletcher | A47C 1/0355 | 297/83 X |
| 3,743,348 A * | 7/1973 | Sloan | A47C 1/0355 | 297/85 M X |
| 4,071,275 A * | 1/1978 | Rogers, Jr. | A47C 1/0355 | 297/85 L X |
| 4,108,491 A * | 8/1978 | Rogers, Jr. | A47C 1/0355 | 297/85 L X |
| 4,185,869 A * | 1/1980 | Rogers, Jr. | A47C 1/0355 | 297/84 X |

(Continued)

FOREIGN PATENT DOCUMENTS

| | | |
|---|---|---|
| CN | 105455470 A | 4/2016 |
| CN | 108125435 A | 6/2018 |

*Primary Examiner* — Rodney B White
(74) *Attorney, Agent, or Firm* — Locke Lord LLP; Tim Tingkang Xia, Esq.

(57) ABSTRACT

A self-locking mechanism includes a frame (1), a transmission member (3), a rotating member (2), and a locking rod (4), forming a four-bar linkage mechanism. A supporting member (6) is movable relative to the frame (1). The rotating member (2) has an upper end rotatably connected with the supporting member (6), a lower end provided with a guide slot (22), and a middle portion therebetween. The transmission member (3) has two ends rotatably connected with the frame (1) and the middle portion respectively. The locking rod (4) has an upper end rotatably connected with the frame (1), and a lower end provided with a guide rod (41) movable in the guide slot. The locking rod (4) is rotatable between multiple positions. When the locking rod (4) is in a locking position, the guide rod (41) abuts against the guide slot to prevent the supporting member (6) from moving upward.

15 Claims, 9 Drawing Sheets

(56) References Cited

U.S. PATENT DOCUMENTS 4,185,870 A * 1/1980 Johnson ..... A47C 1/035 297/84 X
4,226,468 A * 10/1980 Johnson ..... A47C 1/0347 297/83 X
4,247,146 A * 1/1981 Cycowicz ..... A47C 1/0347 297/317
4,291,913 A * 9/1981 Kowalski ..... A47C 1/0345 297/68 X
4,337,977 A * 7/1982 Rogers, Jr. ..... A47C 1/0355 297/85 L X
4,350,387 A * 9/1982 Rogers, Jr. ..... A47C 1/0355 297/85 R X
4,357,049 A * 11/1982 Rogers, Jr. ..... A47C 1/0355 297/85 R X
4,418,957 A * 12/1983 Rogers, Jr. ..... A47C 1/0355 297/85 R X
4,544,201 A * 10/1985 Rogers, Jr. ..... A47C 3/0255 297/84 X
4,601,513 A * 7/1986 Pine ..... A47C 3/03 297/85 L X
4,707,025 A * 11/1987 Rogers, Jr. ..... A47C 3/027 297/85 L X
4,815,788 A * 3/1989 May ..... A47C 1/0355 297/85 L X
4,878,710 A * 11/1989 Tacker ..... A47C 1/0355 297/85 L X
4,904,019 A * 2/1990 May ..... A47C 1/0355 297/68 X
4,946,222 A * 8/1990 Matson ..... A61G 5/14 297/330 X
4,989,914 A * 2/1991 Pine ..... A47C 1/0352 297/85 L X
5,072,988 A * 12/1991 Plunk ..... A47C 1/0355 297/68 X
5,312,153 A * 5/1994 Lin ..... A47C 1/0345 297/DIG. 10 X
5,360,255 A * 11/1994 Cook ..... A47C 1/0355 297/68 X
5,975,627 A * 11/1999 LaPointe ..... A47C 1/0355 297/83 X
6,000,758 A * 12/1999 Schaffner ..... A47C 1/0345 297/83 X
6,409,262 B1 * 6/2002 LaPointe ..... A47C 1/0352 297/83 X
7,850,232 B2 * 12/2010 Casteel ..... A47C 1/0352 297/85 L
9,603,453 B2 * 3/2017 Hoffman ..... A47C 1/0355
2003/0015893 A1 * 1/2003 Hoffman ..... G06F 17/142 297/85 R

* cited by examiner

SELF-LOCKING MECHANISM AND LIFT CHAIR THEREWITH

CROSS-REFERENCE TO RELATED PATENT APPLICATIONS

This non-provisional application claims priority to and the benefit of, pursuant to 35 U.S.C. § 119(a), patent application Serial Nos. CN201922451035.8 and CN201911392482.9, both filed in China on Dec. 30, 2019. The disclosure of the above applications is incorporated herein in their entireties by reference.

FIELD

The present invention generally relates to a lift chair, and particularly to a self-locking mechanism and a lift chair therewith.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, an electronic sofa or a seating furniture is formed by a lift chair metal frame, which functions as the main supporting structure, filled with a filler material (which may be a sponge material or other soft materials) and covered by a covering material (which may be a leather material such as cowhide or cattle hide, or other covering materials), which may be in a luxurious and sophisticated style, and may be widely used in any environment.

A conventional metal frame of an electronic sofa may be formed by a fixed base, a main frame, a supporting member, a backrest member, a footrest member, and a bar linkage mechanism. The main frame is movable relative to the fixed base. The supporting member, the backrest member and the footrest member are all mounted on the main frame through the bar linkage mechanism. By moving the supporting member among different positions relative to the main frame, the bar linkage mechanism may drive the backrest member and the footrest member to move to different positions and to extend or recline ergonomically, allowing the sofa to provide multiple different stances.

FIGS. 1-5 shows a conventional lift chair metal frame in different stances. Specifically, FIG. 1 shows the metal frame in an assisting stance, where the main frame 910 moves upward, the supporting member and the backrest member incline forward, and the footrest member moves to a stowed position to assist the user to stand up from the sofa. FIG. 2 shows the metal frame in an initial stance, where the main frame 910 moves downward to a seating position, the supporting member moves to an initial position relative to the main frame 910, the backrest member maintains a stowed and relatively vertical position, and the footrest member maintains the stowed position, allowing the user to sit on the sofa in a regular sitting stance. FIG. 3 shows the metal frame in a footrest stance, where the footrest member moves to a reclined position, such that the user may put the legs on the footrest member while the upper body of the user maintains a relatively straight position, allowing the user to watch TV or read a book. FIG. 4 shows the metal frame in a recreational stance, where the footrest member maintains the reclined position, and the backrest member inclines and extends backward to move to a reclined position, allowing the user to recline on the extended sofa in a reclining or half-lying position.

FIG. 5 shows an exemplary bar linkage mechanism of the conventional metal frame. As shown in FIG. 5, the bar linkage mechanism includes a rear rotating member 92, a rear transmission member 93, a middle member 96, a front transmission member 97, and a front rotating member 98. The rear rotating member 92 has an upper end rotatably connected with the supporting member 91, and a lower end rotatably connected with an upper end of the rear transmission member 93. The rear transmission member 93 has the upper end rotatably connected with the lower end of the rear rotating member 92, a middle end rotatably connected with the frame 910, and a lower end rotatably connected with the middle member 96. The front rotating member 98 has an upper end rotatably connected with the supporting member 91, and a lower end rotatably connected with an upper end of the front transmission member 97. The front transmission member 97 has the upper end rotatably connected with the lower end of the front rotating member 98, a middle end rotatably connected with the frame 910, and a lower end rotatably connected with the middle member 96. The middle member 96 has two ends rotatably connected with the lower ends of the rear transmission member 93 and the front transmission member 97 respectively. In other words, the supporting member 91 is mounted on the main frame 910 through the bar linkage mechanism formed by the rear rotating member 92, the rear transmission member 93, the middle member 96, the front transmission member 97, and the front rotating member 98.

In the conventional metal frame, the supporting member is only locked in the assisting stance as shown in FIG. 1 and the initial stance as shown in FIG. 2. Specifically, as shown in FIGS. 1-4, an L-shaped supporting member 95 is provided between the backrest member and the frame 910, and a position limiting pin 94 is formed at a rear end of the supporting member 91. When the metal frame is in the initial stance as shown in FIG. 2, the supporting member 91 moves to the initial position, and the position limiting pin 94 hooks the L-shaped supporting member 95, facilitating self-locking of the metal frame (where the supporting member 91 does not move upward, and the footrest member does not extend to the reclined position). When the metal frame is in the self-locking status, the frame 910 may be lifted to adjust the supporting member 91 to the assisting stance. In other words, the hook matching of the position limiting pin 94 and the L-shaped supporting member 95 allows the metal frame to facilitate self-locking in the initial stance and the assisting stance. However, when the metal frame is in the footrest stance as shown in FIG. 3 or the recreational stance as shown in FIG. 4, the position limiting pin 94 is detached from the L-shaped supporting member 95. In this case, if the supporting member 91 is subject to an upward external force (which may be generated by lifting the footrest member 99 or by pressing the backrest member), the supporting member 91 may move to a upward lifting and rotating position, which is not under control of the driving mechanism of the lift chair, creating a safety issue for the user.

Therefore, a heretofore unaddressed need exists in the art to address the aforementioned deficiencies and inadequacies.

SUMMARY

The present invention, in one aspect, relates to a self-locking mechanism used in a lift chair.

In one embodiment, the self-locking mechanism includes: a frame (1), configured to move relative to a base of the lift chair; a supporting member (6), configured to move relative to the frame (1) in a front-rear direction; a rear rotating member (2), having an upper end rotatably connected with the supporting member (6), a lower end provided with a guide slot, and a middle portion between the upper end and the lower end; a rear transmission member (3), having a first end rotatably connected with the frame (1), and a second end rotatably connected with the middle portion of the rear rotating member (2); and a locking rod (4), having an upper end rotatably connected with the frame (1), and a lower end provided with a guide rod (41), wherein the guide rod (41) is movable in the guide slot; wherein the frame (1), the rear transmission member (3), the rear rotating member (2) and the locking rod (4) form a four-bar linkage mechanism; and wherein the locking rod (4) is rotatable between a plurality of positions, the positions include a plurality of locking positions, and when the locking rod (4) is in each of the locking positions, the guide rod (41) abuts against a bottom end of the guide slot to prevent the supporting member (6) from moving upward.

In one embodiment, the first end of the rear transmission member (3) is rotatably connected with the frame (1) through a first rivet (51), the second end of the rear transmission member (3) is rotatably connected with the middle portion of the rear rotating member (2) through a second rivet (52), the upper end of the locking rod (4) is rotatably connected with the frame (1) through a third rivet (53), and axial directions of the first rivet (51), the second rivet (52) and the third rivet (53) are in parallel with one another.

In one embodiment, when the locking rod (4) is in each of the locking positions, the axial directions of the second rivet (52) and the third rivet (53) are collinear.

In one embodiment, the self-locking mechanism further includes a position limiting pin (7) fixed to the frame (1), and when the locking rod (4) is in each of the locking positions, the rear transmission member (3) is in contact with the position limiting pin (7) such that the position limiting pin (7) supports the rear transmission member (3).

In one embodiment, the locking positions include a first locking position and a second locking position; when the locking rod (4) is in the first locking position, the first rivet (51), the third rivet (53) and the guide rod (41) form a self-locking triangular structure, and the supporting member (6) is located at a front side relative to the frame (1); when the locking rod (4) is in the second locking position, the first rivet (51), the third rivet (53) and the guide rod (41) are all aligned along a same line perpendicular to the axial directions, and the supporting member (6) is located at a back side relative to the frame (1); and when the locking rod (4) is in a position between the first locking position and the second locking position, the locking rod (4) prevents the rear rotating member (2) from moving upward, and further prevents the supporting member (6) from moving upward.

In one embodiment, the positions further include an unlocking position, and the second locking position is between the first locking position and the unlocking position; and when the locking rod (4) is in the unlocking position, the axial directions of the second rivet (52) and the third rivet (53) are not collinear, the rear transmission member (3) is not in contact with the position limiting pin (7), and the guide rod (41) does not abut against the bottom end of the guide slot, and the first rivet (51), the third rivet (53) and the guide rod (41) are not all aligned along the same line and do not form the self-locking triangular structure.

In one embodiment, the supporting member (6) is movable between a first position, a second position, a third position and a fourth position; when the supporting member (6) is in the first position or the second position, the locking rod (4) is in the first locking position; when the supporting member (6) is in the third position, the locking rod (4) is in the second locking position; and when the supporting member (6) is in the fourth position, the locking rod (4) is in the unlocking position.

In one embodiment, the self-locking mechanism further includes a spring connecting the frame (1) and the supporting member (6), and when the locking rod (4) is in the unlocking position, the spring is configured to provide a downward elastic force on the supporting member (6) to prevent the supporting member (6) from moving upward.

In another aspect, the present invention relates to a lift chair. In one embodiment, the lift chair includes a base and a self-locking mechanism, and the self-locking mechanism includes: a frame (1), configured to move relative to a base of the lift chair; a supporting member (6), configured to move relative to the frame (1) in a front-rear direction; a rear rotating member (2), having an upper end rotatably connected with the supporting member (6), a lower end provided with a guide slot, and a middle portion between the upper end and the lower end; a rear transmission member (3), having a first end rotatably connected with the frame (1), and a second end rotatably connected with the middle portion of the rear rotating member (2); and a locking rod (4), having an upper end rotatably connected with the frame (1), and a lower end provided with a guide rod (41), wherein the guide rod (41) is movable in the guide slot; wherein the frame (1), the rear transmission member (3), the rear rotating member (2) and the locking rod (4) form a four-bar linkage mechanism; and wherein the locking rod (4) is rotatable between a plurality of positions, the positions include a plurality of locking positions, and when the locking rod (4) is in each of the locking positions, the guide rod (41) abuts against a bottom end of the guide slot to prevent the supporting member (6) from moving upward.

In one embodiment, the first end of the rear transmission member (3) is rotatably connected with the frame (1) through a first rivet (51), the second end of the rear transmission member (3) is rotatably connected with the middle portion of the rear rotating member (2) through a second rivet (52), the upper end of the locking rod (4) is rotatably connected with the frame (1) through a third rivet (53), and axial directions of the first rivet (51), the second rivet (52) and the third rivet (53) are in parallel with one another.

In one embodiment, the self-locking mechanism further includes a position limiting pin (7) fixed to the frame (1), and when the locking rod (4) is in each of the locking positions, the axial directions of the second rivet (52) and the third rivet (53) are collinear, and the rear transmission member (3) is in contact with the position limiting pin (7) such that the position limiting pin (7) supports the rear transmission member (3).

In one embodiment, the locking positions include a first locking position and a second locking position; when the locking rod (4) is in the first locking position, the first rivet (51), the third rivet (53) and the guide rod (41) form a self-locking triangular structure, and the supporting member (6) is located at a front side relative to the frame (1); when the locking rod (4) is in the second locking position, the first rivet (51), the third rivet (53) and the guide rod (41) are all aligned along a same line perpendicular to the axial directions, and the supporting member (6) is located at a back side relative to the frame (1); and when the locking rod (4) is in a position between the first locking position and the second locking position, the locking rod (4) prevents the rear rotating member (2) from moving upward, and further prevents the supporting member (6) from moving upward.

In one embodiment, the positions further include an unlocking position, and the second locking position is between the first locking position and the unlocking position; and when the locking rod (4) is in the unlocking position, the axial directions of the second rivet (52) and the third rivet (53) are not collinear, the rear transmission member (3) is not in contact with the position limiting pin (7), and the guide rod (41) does not abut against the bottom end of the guide slot, and the first rivet (51), the third rivet (53) and the guide rod (41) are not all aligned along the same line and do not form the self-locking triangular structure.

In one embodiment, the supporting member (6) is movable between a first position, a second position, a third position and a fourth position; when the supporting member (6) is in the first position or the second position, the locking rod (4) is in the first locking position; when the supporting member (6) is in the third position, the locking rod (4) is in the second locking position; and when the supporting member (6) is in the fourth position, the locking rod (4) is in the unlocking position.

In one embodiment, the self-locking mechanism further includes a spring connecting the frame (1) and the supporting member (6), and when the locking rod (4) is in the unlocking position, the spring is configured to provide a downward elastic force on the supporting member (6) to prevent the supporting member (6) from moving upward.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
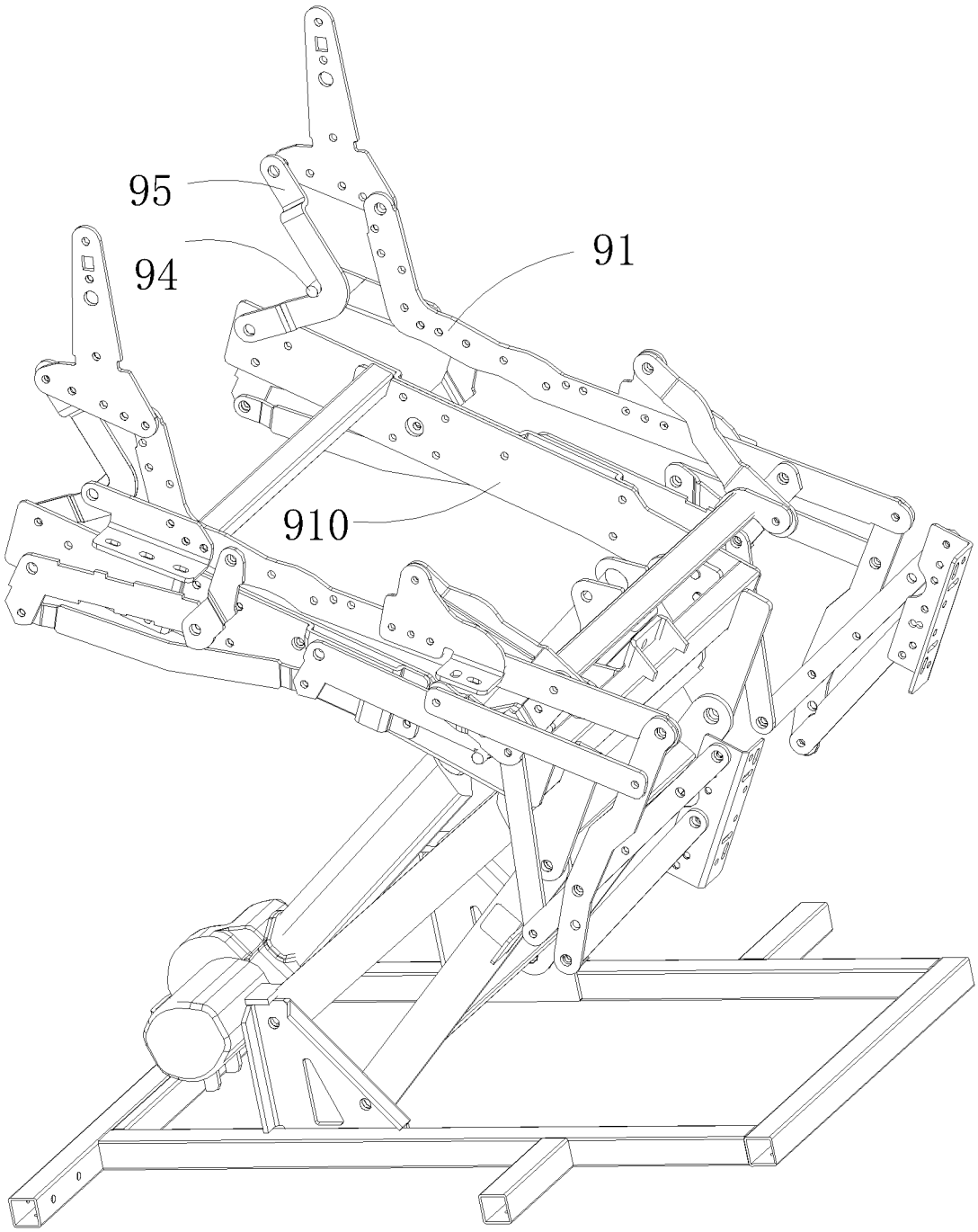
FIG. 1 (Related Art)
FIG. 1 is a schematic view of a conventional lift chair metal frame in an assisting stance.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower" can therefore encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature. As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

The description will be made as to the embodiments of the present invention in conjunction with the accompanying drawings. In accordance with the purposes of this invention, as embodied and broadly described herein, this invention, in one aspect, relates to a self-locking mechanism used in a lift chair.

Figure 2:
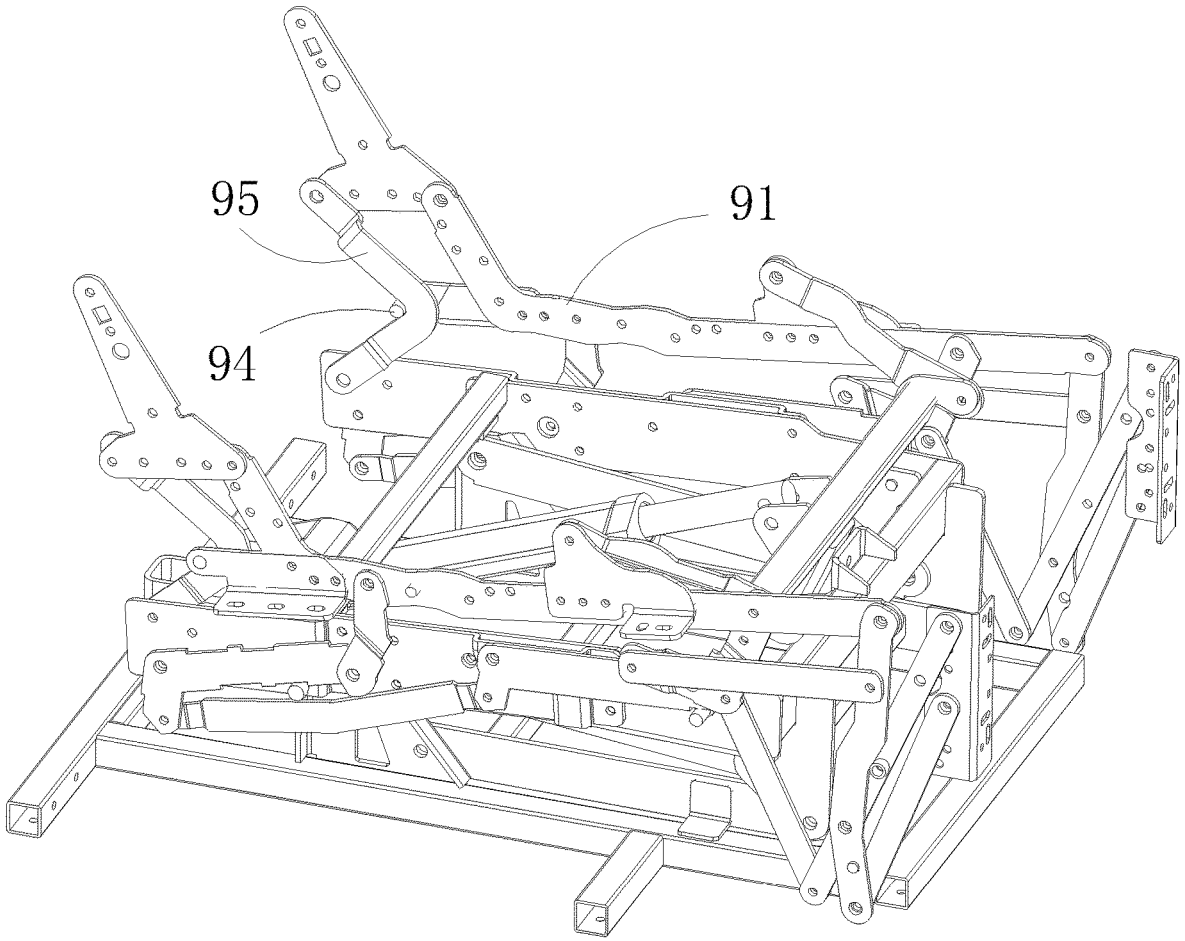
FIG. 2 (Related Art)
FIG. 2 is a schematic view of the conventional lift chair metal frame in an initial stance.
Figure 3:
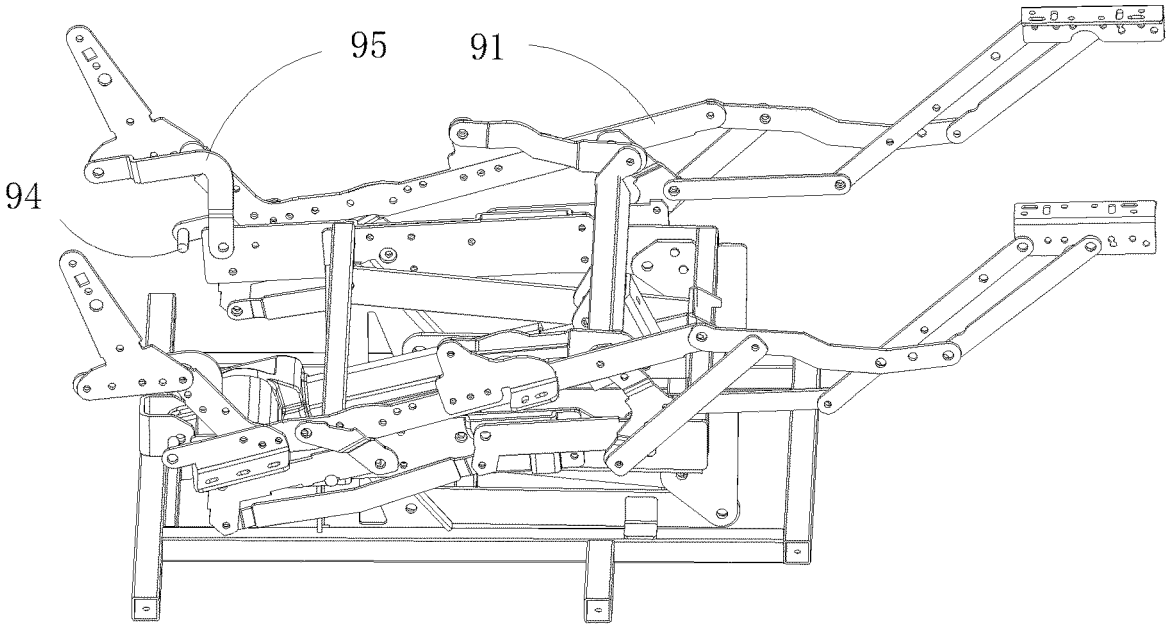
FIG. 3 (Related Art)
FIG. 3 is a schematic view of the conventional lift chair metal frame in a footrest stance.
Figure 4:
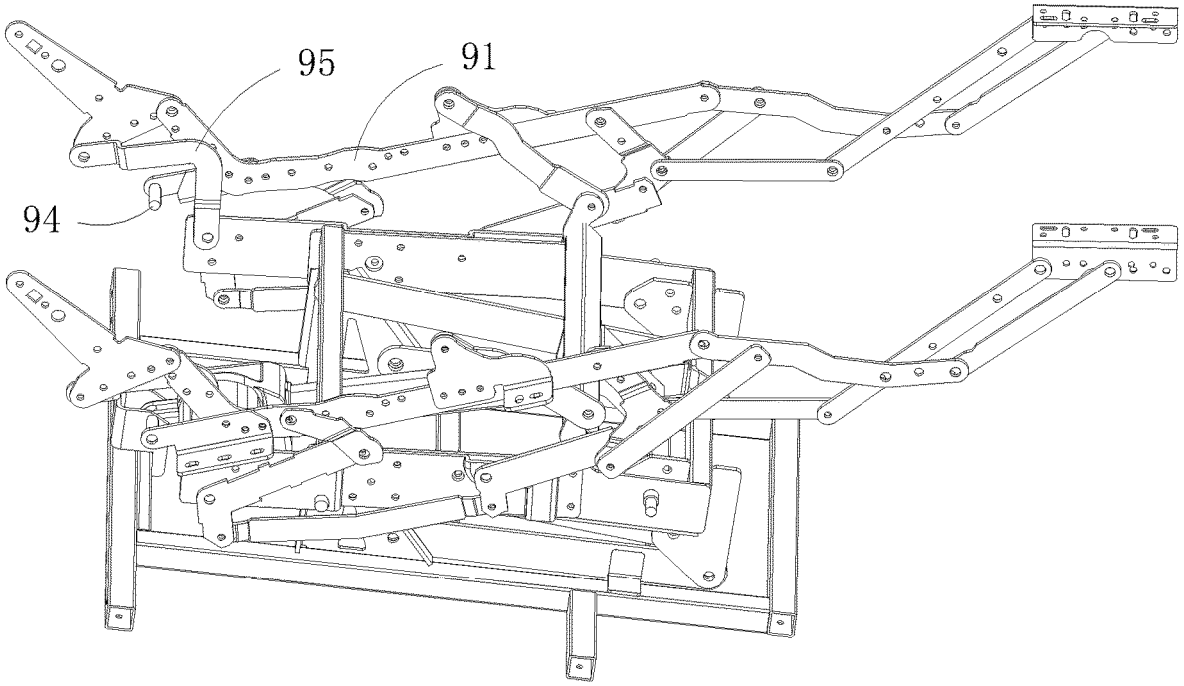
FIG. 4 (Related Art)
FIG. 4 is a schematic view of the conventional lift chair metal frame in a recreational stance.
Figure 5:
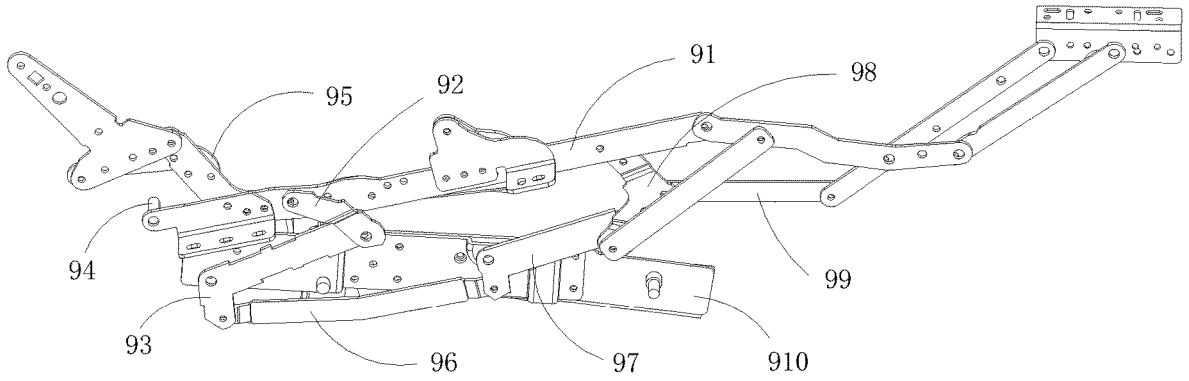
FIG. 5 (Related Art)
FIG. 5 is a schematic view of the bar linkage mechanism of the conventional lift chair metal frame.
Figure 6:
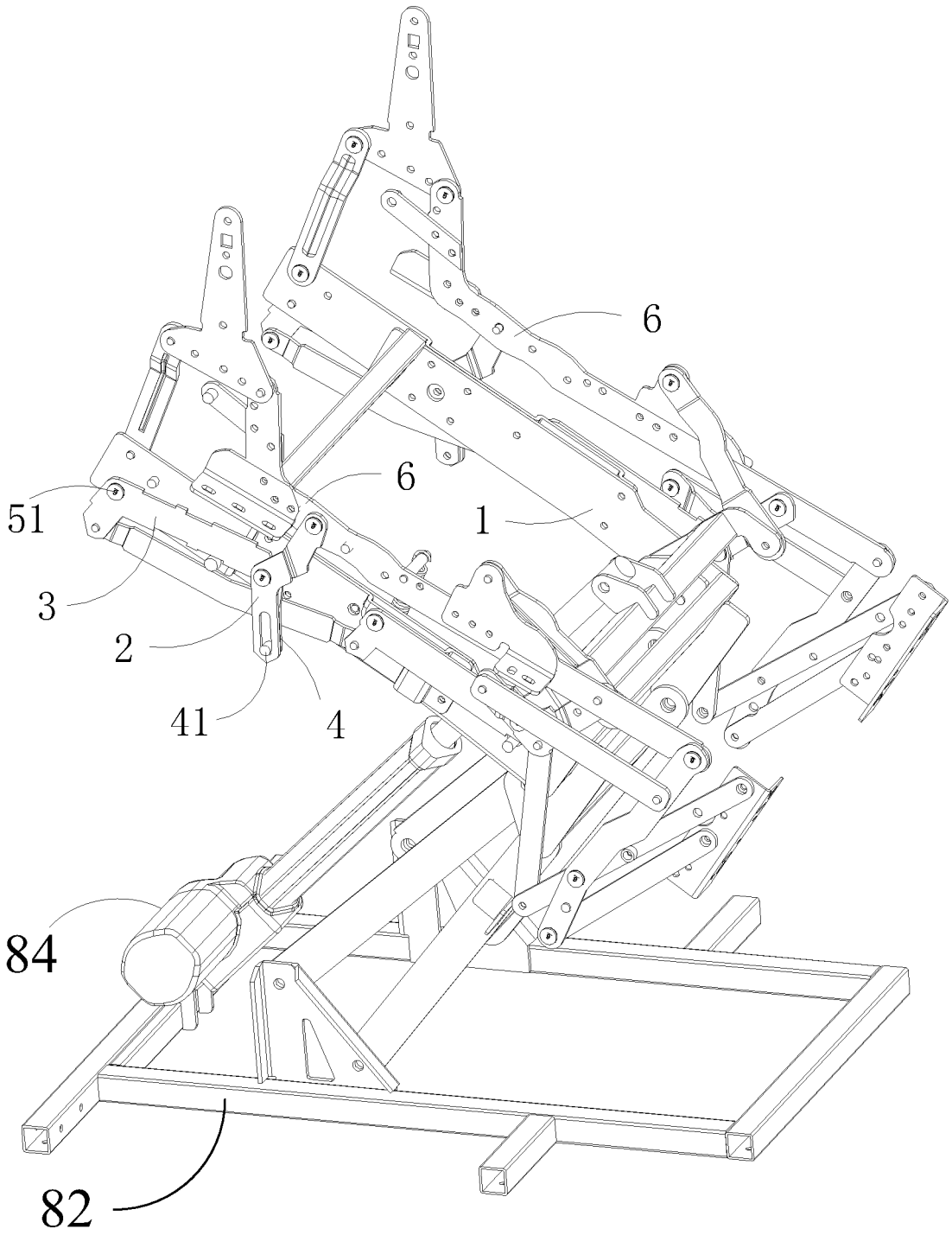
FIG. 6 is a schematic view of a self-locking mechanism of a lift chair in an assisting stance according to certain embodiments of the present invention.
Figure 7:
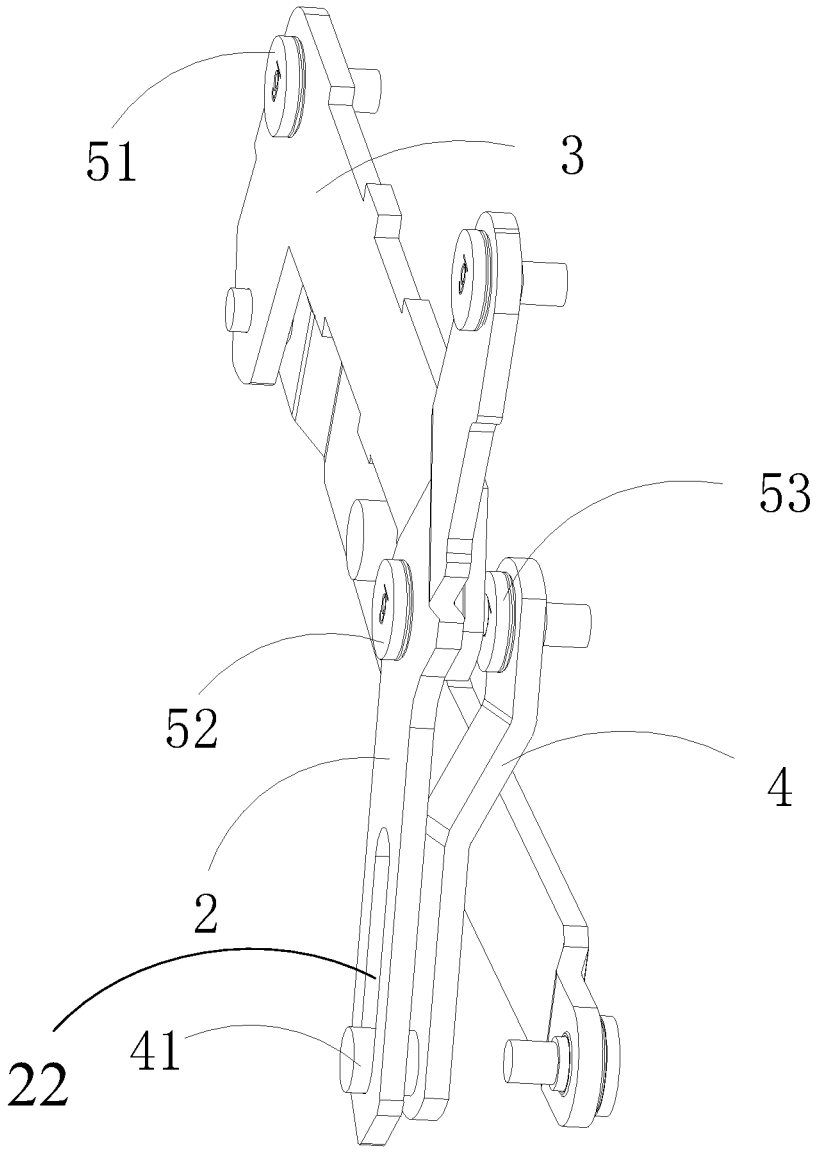
FIG. 7 is a schematic view of the rear rotating member, the rear transmission member and the locking member of the self-locking mechanism in the assisting stance as shown in FIG. 6.
Figure 8:
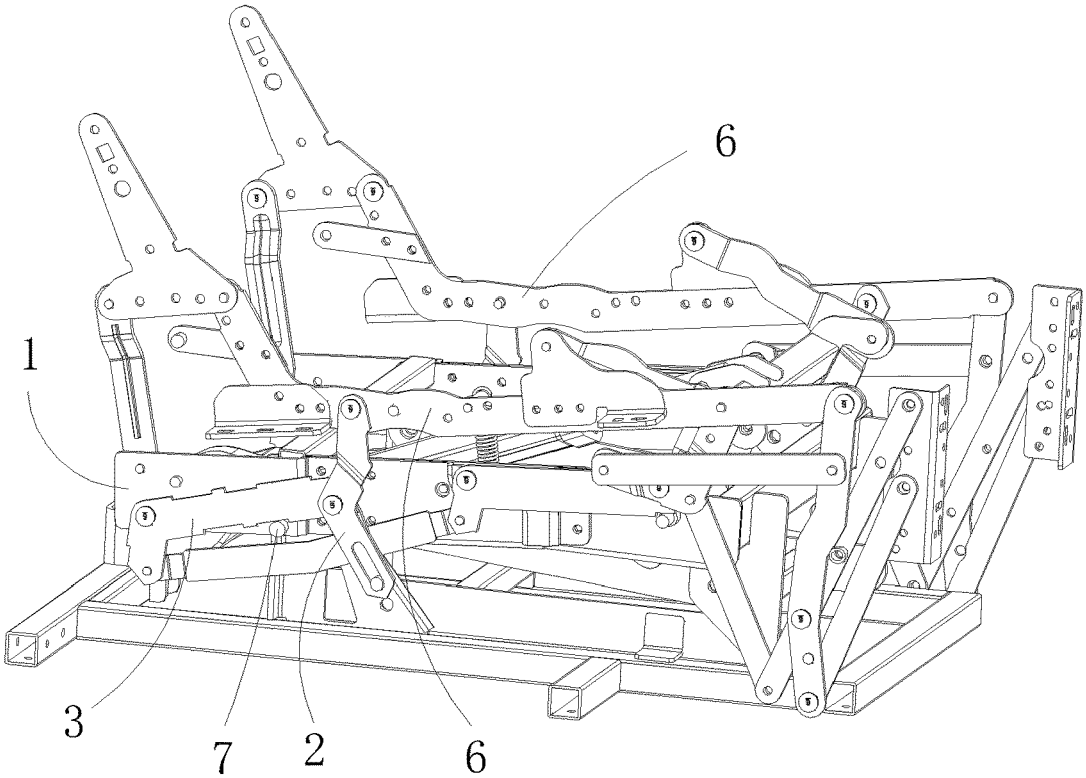
FIG. 8 is a schematic view of a self-locking mechanism of a lift chair in an initial stance according to certain embodiments of the present invention.
Figure 9:
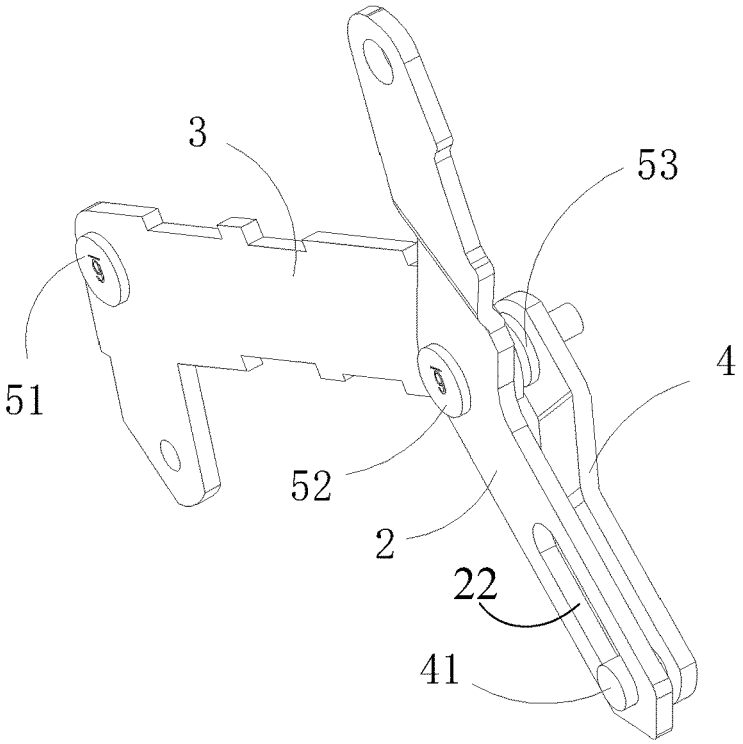
FIG. 9 is a schematic view of the rear rotating member, the rear transmission member and the locking member of the self-locking mechanism in the initial stance as shown in FIG. 8.
Figure 10:
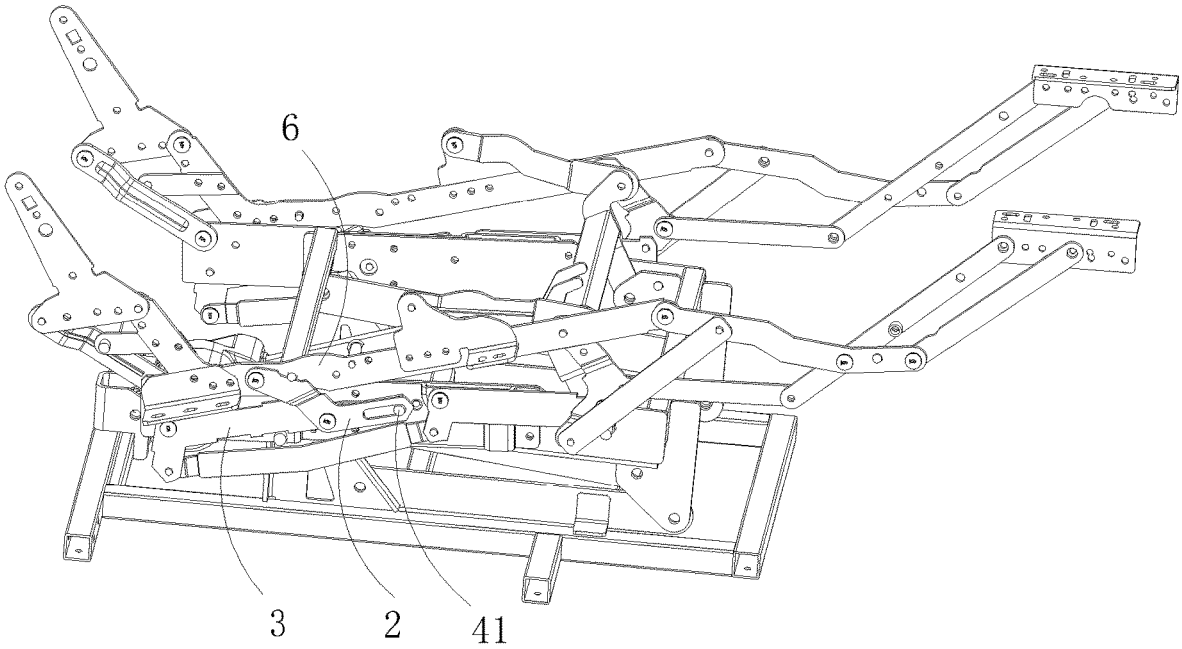
FIG. 10 is a schematic view of a self-locking mechanism of a lift chair in a footrest stance according to certain embodiments of the present invention.
Figure 11:
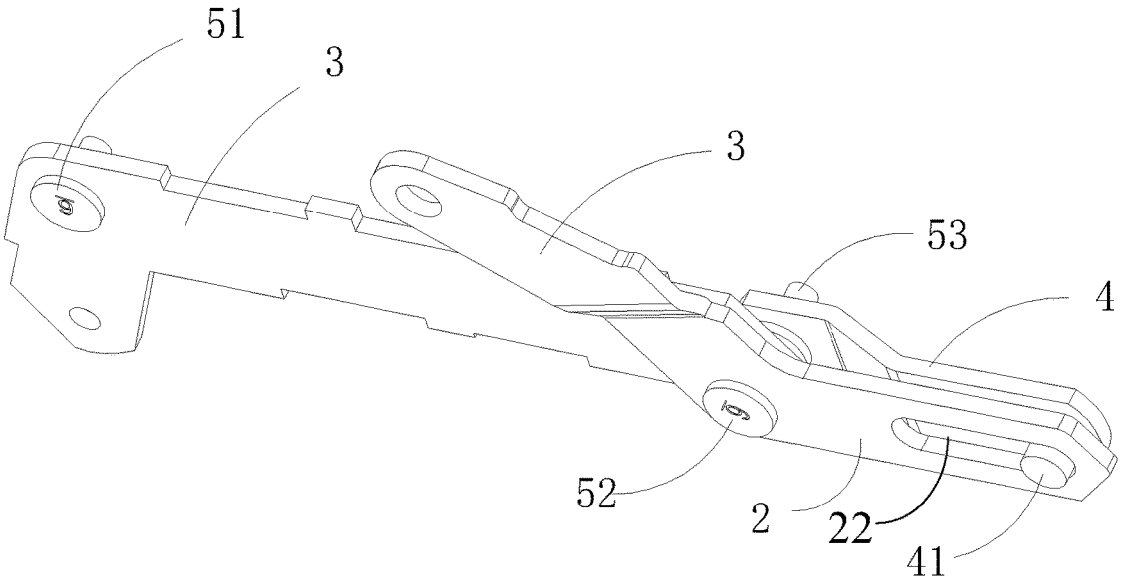
FIG. 11 is a schematic view of the rear rotating member, the rear transmission member and the locking member of the self-locking mechanism in the footrest stance as shown in FIG. 10.
Figure 12:
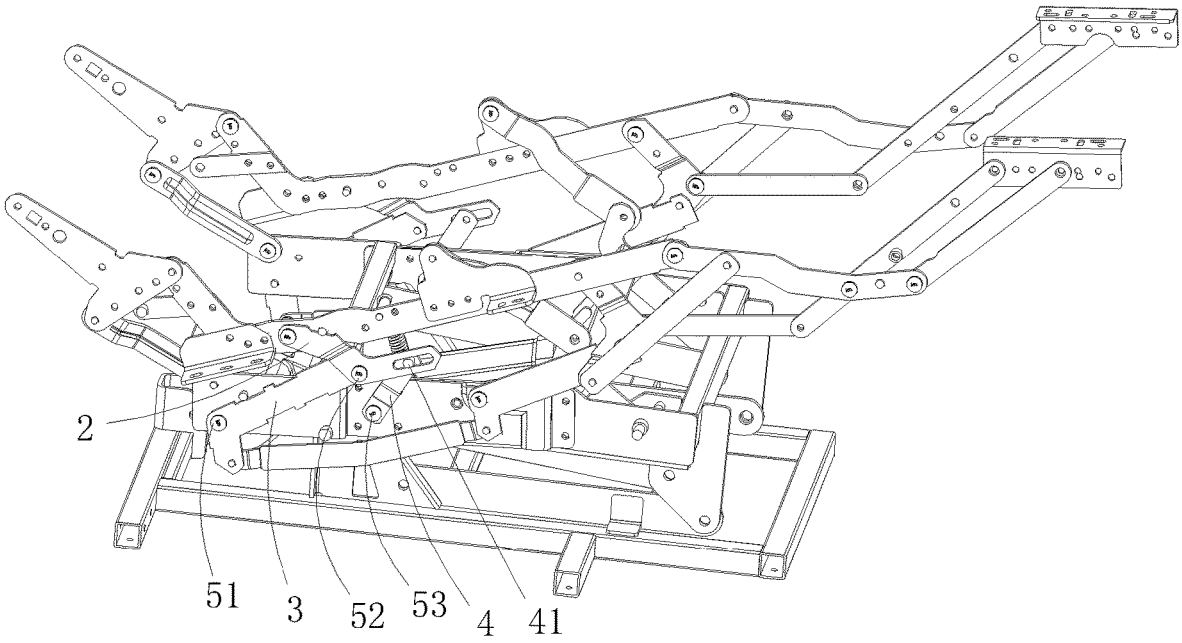
FIG. 12 is a schematic view of a self-locking mechanism of a lift chair in a recreational stance according to certain embodiments of the present invention.
Figure 13:
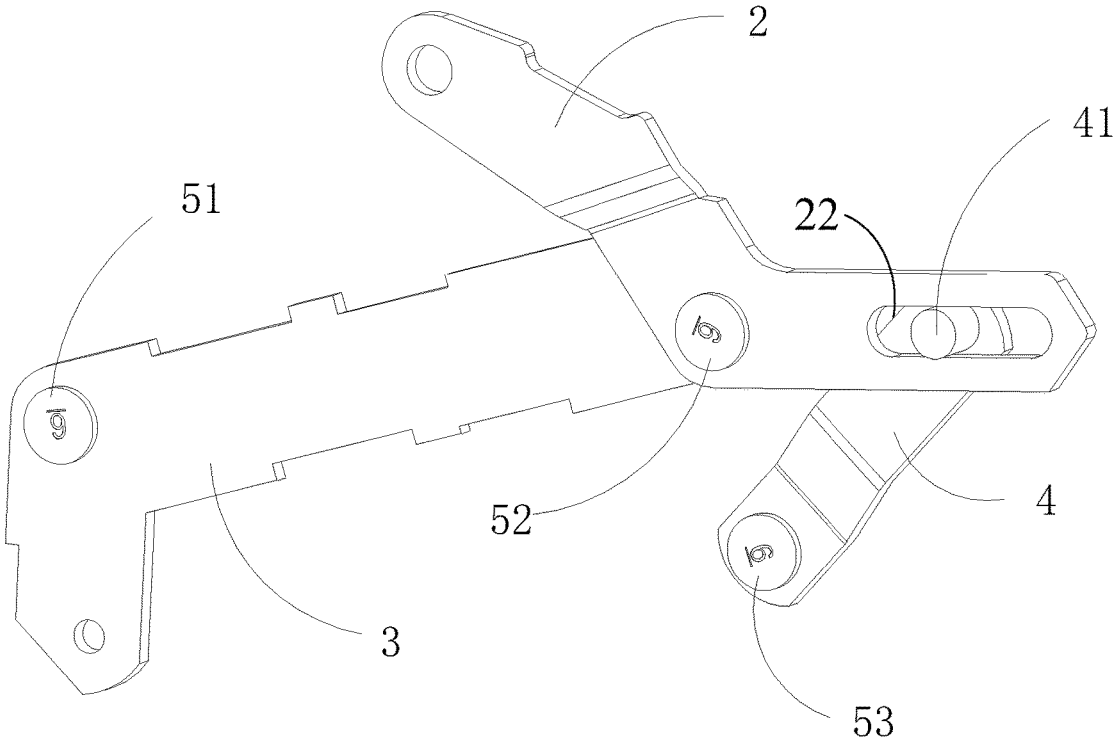
FIG. 13 is a schematic view of the rear rotating member, the rear transmission member and the locking member of the self-locking mechanism in the recreational stance as shown in FIG. 12.

One aspect of the present invention relates to a self-locking mechanism used in a lift chair. For example, FIGS. 6-13 schematically shows a self-locking mechanism according to certain embodiments of the present invention. Specifically, FIGS. 6 and 7 show the self-locking mechanism in a first stance (which is an assisting stance, similar to the assisting stance as shown in FIG. 1). FIGS. 8 and 9 show the self-locking mechanism in a second stance (which is an initial stance, similar to the initial stance as shown in FIG. 2). FIGS. 10 and 11 show the self-locking mechanism in a third stance (which is a footrest stance, similar to the footrest stance as shown in FIG. 3). FIGS. 12 and 13 show the self-locking mechanism in a fourth stance (which is a recreational stance, similar to the recreational stance as shown in FIG. 4).

As shown in FIGS. 6-13, the self-locking mechanism includes a frame (1), a rotating member (2), a transmission member (3), a locking rod (4), a supporting member (6) and a position limiting pin (7). Specifically, the frame (1), the rear transmission member (3), the rear rotating member (2) and the locking rod (4) collectively form a four-bar linkage mechanism. It should be noted that the self-locking mechanism may include other additional components for assisting and/or limiting the movement or the rotation of each of the components of the self-locking mechanism, and details of these additional components are not hereinafter elaborated.

The frame (1) is movable relative to a base (82) of the lift chair. In one embodiment, a driving mechanism (84), which may be formed by a linear motor fixed on the base (82) and a driving cylinder connecting the linear motor to the frame (1), is provided to drive the frame (1) to move relative to the base of the lift chair in an obliquely vertical direction (see FIG. 6).

The supporting member (6) is movable relative to the frame (1) in a substantially front-rear direction, and is used to support the seating portion of the lift chair. In one embodiment, a driving mechanism (not shown) is provided to drive the supporting member (6) to move relative to the frame (1), and the driving mechanism may be similar to the driving mechanism (84) for driving the frame (1), which may include a linear motor and a driving cylinder. In certain embodiments, the supporting member (6) is movable between a first position as shown in FIGS. 6 and 7, a second position as shown in FIGS. 8 and 9, a third position as shown in FIGS. 10 and 11, and a fourth position as shown in FIGS. 12 and 13. In other words, when the supporting member (6) is in the first position, the lift chair is correspondingly in the first stance; when the supporting member (6) is in the second position, the lift chair is correspondingly in the second stance; when the supporting member (6) is in the third position, the lift chair is correspondingly in the third stance; and when the supporting member (6) is in the fourth position, the lift chair is correspondingly in the fourth stance. The first position and the second position are relatively located at a front side relative to the frame (1), and the third position and the fourth position are relatively located at a back side relative to the frame (1).

The rear transmission member (3), the rear rotating member (2) and the locking rod (4) are components of the bar linkage mechanism of the self-locking mechanism.

Specifically, the rear rotating member (2) has an upper end rotatably connected with the supporting member (6), a lower end provided with a guide slot, and a middle portion between the upper end and the lower end. The rear transmission member (3) has a first end rotatably connected with the frame (1) through a first rivet (51), and a second end rotatably connected with the middle portion of the rear rotating member (2) through a second rivet (52). The locking rod (4) has an upper end rotatably connected with the frame (1) through a third rivet (53), and a lower end provided with a guide rod (41). The guide rod (41) is movable in the guide slot, such that the locking rod (4) and the rear rotating member (2) are rotatably and slidably connected through the matching of the guide rod (41) and the guide slot. In one embodiment, axial directions of the first rivet (51), the second rivet (52) and the third rivet (53) are in parallel with one another.

In one embodiment, when the driving mechanism (not shown) drives the supporting member (6) to move relative to the frame (1), the supporting member (6) consequently drives the rear rotating member (2) to rotate, and the rear rotating member (2) drives the rear transmission member (3) and the locking rod (4) to respectively rotate relative to the frame (1). In this case, the frame (1), the rear transmission member (3), the rear rotating member (2) and the locking rod (4) collectively form the four-bar linkage mechanism.

The position limiting pin (7) is fixed to the frame (1) to provide support for the rear transmission member (3) when the self-locking mechanism performs the self-locking function. Specifically, when the self-locking mechanism facilitates self-locking as shown in FIGS. 6-11, the position limiting pin (7) is in contact with the rear transmission member (3) to support the rear transmission member (3), as shown in FIGS. 6, 8 and 10. When the self-locking mechanism is released from self-locking, the position limiting pin (7) is not in contact with the rear transmission member (3), as shown in FIG. 12.

The locking rod (4) is rotatable between multiple positions. In certain embodiments, the positions includes a plurality of locking positions as shown in FIGS. 6-11 and at least one unlocking position as shown in FIGS. 12 and 13. Specifically, when the locking rod (4) is in each of the locking positions, the guide rod (41) abuts against a bottom end of the guide slot to prevent the supporting member (6) from moving upward, the axial directions of the second rivet (52) and the third rivet (53) are collinear, and the rear transmission member (3) is in contact with the position limiting pin (7), allowing the self-locking mechanism to facilitate self-locking. When the locking rod (4) is in the unlocking position, the axial directions of the second rivet (52) and the third rivet (53) are not collinear, the rear transmission member (3) is not in contact with the position limiting pin (7), and the guide rod (41) does not abut against the bottom end of the guide slot, and the first rivet (51), the third rivet (53) and the guide rod (41) are not all aligned along the same line and do not form the self-locking triangular structure, such that the self-locking mechanism is released from the self-locking status.

In one embodiment, the locking positions include a first locking position and a second locking position. Specifically, the second locking position is between the first locking position and the unlocking position. When the supporting member (6) is in the first position as shown in FIGS. 6 and 7 or the second position as shown in FIGS. 8 and 9, the locking rod (4) is in the first locking position. When the supporting member (6) is in the third position as shown in FIGS. 10 and 11, the locking rod (4) is in the second locking position. When the supporting member (6) is in the fourth position as shown in FIGS. 12 and 13, the locking rod (4) is in the unlocking position.

Specifically, when the lift chair is in the first stance (i.e., the assisting stance) as shown in FIGS. 6 and 7, the frame (1) moves obliquely upward, and the footrest member moves to a stowed position to assist the user to stand up from the lift chair. In this case, the supporting member (6) is in the first position, which is located at a front side relative to the frame (1), and the locking rod (4) is in the first locking position. As shown in FIG. 7, the axial directions of the second rivet (52) and the third rivet (53) are collinear. In other words, the rotation axis of the rear transmission member (3) relative to the rear rotating member (2) and the rotation axis of the locking rod (4) relative to the frame (1) align with each other to form a collinear rotation axis for both the locking rod (4) and the rear transmission member (3). Further, the guide rod (41) abuts against the bottom end of the guide slot to prevent the supporting member (6) from moving upward, and the rear transmission member (3) is in contact with the position limiting pin (7). Thus, the first rivet (51), the third rivet (53) and the guide rod (41) form a self-locking triangular structure, allowing the self-locking mechanism to facilitate self-locking.

When the lift chair is adjusted to the second stance (i.e., the initial stance) as shown in FIGS. 8 and 9, the frame (1) moves downward to a seating position, and the footrest member remains in the stowed position. In this case, the supporting member (6) is in the second position, which is located at a front side relative to the frame (1), and the locking rod (4) remains in the first locking position relative to the frame (1). As shown in FIG. 9, the axial directions of the second rivet (52) and the third rivet (53) remain collinear. In other words, the rotation axis of the rear transmission member (3) relative to the rear rotating member (2) and the rotation axis of the locking rod (4) relative to the frame (1) remain aligning with each other to form a collinear rotation axis for both the locking rod (4) and the rear transmission member (3). Further, the guide rod (41) remains abutting against the bottom end of the guide slot to prevent the supporting member (6) from moving upward, and the rear transmission member (3) is in contact with the position limiting pin (7). Thus, the first rivet (51), the third rivet (53) and the guide rod (41) maintain the self-locking triangular structure, allowing the self-locking mechanism to facilitate self-locking.

When the lift chair is adjusted to the third stance (i.e., the footrest stance) as shown in FIGS. 10 and 11, the footrest member extends and moves to a reclined position, allowing the user to put the legs on the footrest member. In this case, the supporting member (6) correspondingly moves backward to the third position, which is located at a back side relative to the frame (1), and the locking rod (4) rotates counterclockwise to be in the second locking position relative to the frame (1). As shown in FIG. 11, the axial directions of the second rivet (52) and the third rivet (53) remain collinear. In other words, the rotation axis of the rear transmission member (3) relative to the rear rotating member (2) and the rotation axis of the locking rod (4) relative to the frame (1) remain aligning with each other to form a collinear rotation axis for both the locking rod (4) and the rear transmission member (3). Further, the guide rod (41) remains abutting against the bottom end of the guide slot to prevent the supporting member (6) from moving upward, and the rear transmission member (3) is in contact with the position limiting pin (7). Since the locking rod (4) rotates, the first rivet (51), the third rivet (53) and the guide rod (41) are all aligned along a same line perpendicular to the axial directions, allowing the self-locking mechanism to maintain self-locking. In other words, the second locking position of the locking rod (4) is the final locking position.

It should be noted that the positions of the locking rod (4) between the first locking position as shown in FIGS. 6-9 and the second locking position as shown in FIGS. 10 and 11 form a 90° fan-shaped area, and the self-locking mechanism remains self-locked when the locking rod (4) is located in this 90° fan-shaped area. In other words, any position in this 90° fan-shaped area is a locking position for the locking rod (4). When the locking rod (4) is in a locking position position within this 90° fan-shaped area, the locking rod (4) prevents the rear rotating member (2) from moving upward, and further prevents the supporting member (6) from moving upward. In other words, the locking rod (4) prevents the supporting member (6) from moving upward when the self-locking mechanism is in the first stance (i.e., the assisting stance), the second stance (i.e., the initial stance) or the third stance (i.e., the footrest stance).

When the supporting member (6) is driven to move further backward from the third position to the fourth position, the lift chair is adjusted to the fourth stance (i.e., the recreational stance) as shown in FIGS. 12 and 13, the footrest member maintains in the reclined position, allowing the user to put the legs on the footrest member and the backrest member inclines and extends backward to move to a reclined position, allowing the user to recline on the lift chair in a reclining or half-lying position. In this case, the supporting member (6) is in the fourth position, which is located at a back side relative to the frame (1), and the locking rod (4) further rotates counterclockwise to be in an unlocking position relative to the frame (1). As shown in FIG. 11, as the locking rod (4) further rotates, the first rivet (51), the third rivet (53) and the guide rod (41) are released from being located on the same line, the axial directions of the second rivet (52) and the third rivet (53) are not collinear. In other words, the rotation axis of the rear transmission member (3) relative to the rear rotating member (2) and the rotation axis of the locking rod (4) relative to the frame (1) becomes two different rotation axes. Further, the guide rod (41) is also released from and is thus not in contact with the bottom end of the guide slot (22), and the rear transmission member (3) is not in contact with the position limiting pin (7). Thus, a moving gap exists for the rear rotating member (2), and the self-locking mechanism is released from the self-locking status. In other words, if an upward external force is applied to the supporting member 6, the supporting member 6 may move upward. In one embodiment, the self-locking mechanism further includes a spring (not shown) connecting the frame (1) and the supporting member (6). Thus, when the locking rod (4) is in the unlocking position as shown in FIG. 11, the spring may provide a downward elastic force on the supporting member (6) to prevent the supporting member (6) from moving upward, allowing the supporting member (6) to remain stable in the fourth stance.

In the embodiments as described above, the supporting member (6) may be driven to move between the first position, the second position, the third position and the fourth position in a sequential order, thus switching the lift chair between the first stance (assisting stance), the second stance (initial stance), the third stance (footrest stance) and the fourth stance (recreational stance). Further, the first and second locking positions of the locking rod (4) correspond to the first, second and third stances of the lift chair. In each of the first, second and third stances, the self-locking mechanism remains in the self-locking status, preventing the supporting member (6) from moving upward. Compared to the conventional lift chair style electronic sofa, the self-locking mechanism according to certain embodiments of the present invention further enables self-locking in the third stance when the footrest member extends, allowing the supporting member (6) to remain stable.

In another aspect of the present invention, a lift chair may utilize the self-locking mechanism as described above. As discussed, the lift chair may be switchable between the first stance (assisting stance), the second stance (initial stance), the third stance (footrest stance) and the fourth stance (recreational stance) by driving the supporting member 6 to move between the first, second, third and fourth positions. In each of the first, second and third stances, the self-locking mechanism remains in the self-locking status, preventing the supporting member (6) from moving upward. Compared to the conventional lift chair style electronic sofa, the lift chair according to certain embodiments of the present invention further enables self-locking in the third stance when the footrest member extends, allowing the supporting member (6) to remain stable.

It should be noted that the lift chair may include other additional components for providing other functions of the lift chair. For example, the lift chair may include a seating portion, a footrest member and a backrest member. Details of these additional components of the lift chair are not hereinafter elaborated.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A self-locking mechanism used in a lift chair, comprising:

a frame (1), movable relative to a base (82) of the lift chair;

a supporting member (6), configured to move relative to the frame (1);

a rear rotating member (2), having an upper end rotatably connected with the supporting member (6), a lower end provided with a guide slot (22), and a middle portion between the upper end and the lower end;

a rear transmission member (3), having a first end rotatably connected with the frame (1), and a second end rotatably connected with the middle portion of the rear rotating member (2); and a locking rod (4), having an upper end rotatably connected with the frame (1), and a lower end provided with a guide rod (41), wherein the guide rod (41) is movable in the guide slot (22);

wherein the frame (1), the rear transmission member (3), the rear rotating member (2) and the locking rod (4) form a four-bar linkage mechanism; and wherein the locking rod (4) is rotatable between a plurality of positions, the positions comprise a plurality of locking positions, and when the locking rod (4) is in each of the locking positions, the guide rod (41) abuts against a bottom end of the guide slot (22) to prevent the supporting member (6) from moving upward.

2. The self-locking mechanism according to claim 1, wherein the first end of the rear transmission member (3) is rotatably connected with the frame (1) through a first rivet (51), the second end of the rear transmission member (3) is rotatably connected with the middle portion of the rear rotating member (2) through a second rivet (52), the upper end of the locking rod (4) is rotatably connected with the frame (1) through a third rivet (53), and axial directions of the first rivet (51), the second rivet (52) and the third rivet (53) are in parallel with one another.

3. The self-locking mechanism according to claim 2, wherein when the locking rod (4) is in each of the locking positions, the axial directions of the second rivet (52) and the third rivet (53) are collinear.

4. The self-locking mechanism according to claim 3, further comprising a position limiting pin (7) fixed to the frame (1), wherein when the locking rod (4) is in each of the locking positions, the rear transmission member (3) is in contact with the position limiting pin (7) such that the position limiting pin (7) supports the rear transmission member (3).

5. The self-locking mechanism according to claim 4, wherein:

the locking positions comprise a first locking position and a second locking position;

when the locking rod (4) is in the first locking position, the first rivet (51), the third rivet (53) and the guide rod (41) form a self-locking triangular structure, and the supporting member (6) is located at a front side relative to the frame (1);

when the locking rod (4) is in the second locking position, the first rivet (51), the third rivet (53) and the guide rod (41) are all aligned along a same line perpendicular to the axial directions, and the supporting member (6) is located at a back side relative to the frame (1); and when the locking rod (4) is in a position between the first locking position and the second locking position, the locking rod (4) prevents the rear rotating member (2) from moving upward, and further prevents the supporting member (6) from moving upward.

6. The self-locking mechanism according to claim 5, wherein:

the positions further comprise an unlocking position, and the second locking position is between the first locking position and the unlocking position;

when the locking rod (4) is in the unlocking position, the axial directions of the second rivet (52) and the third rivet (53) are not collinear, the rear transmission member (3) is not in contact with the position limiting pin (7), and the guide rod (41) does not abut against the bottom end of the guide slot (22), and the first rivet (51), the third rivet (53) and the guide rod (41) are not all aligned along the same line and do not form the self-locking triangular structure.

7. The self-locking mechanism according to claim 6, wherein:

the supporting member (6) is movable between a first position, a second position, a third position and a fourth position;

when the supporting member (6) is in the first position or the second position, the locking rod (4) is in the first locking position;

when the supporting member (6) is in the third position, the locking rod (4) is in the second locking position; and when the supporting member (6) is in the fourth position, the locking rod (4) is in the unlocking position.

8. The self-locking mechanism according to claim 7, further comprising a spring connecting the frame (1) and the supporting member (6), wherein when the locking rod (4) is in the unlocking position, the spring is configured to provide a downward elastic force on the supporting member (6) to prevent the supporting member (6) from moving upward.

9. A lift chair, comprising:

a base (82); and a self-locking mechanism, comprising:

a frame (1), configured to move relative to the base;

a supporting member (6), configured to move relative to the frame (1);

a rear rotating member (2), having an upper end rotatably connected with the supporting member (6), a lower end provided with a guide slot (22), and a middle portion between the upper end and the lower end;

a rear transmission member (3), having a first end rotatably connected with the frame (1), and a second end rotatably connected with the middle portion of the rear rotating member (2); and a locking rod (4), having an upper end rotatably connected with the frame (1), and a lower end provided with a guide rod (41), wherein the guide rod (41) is movable in the guide slot (22);

wherein the frame (1), the rear transmission member (3), the rear rotating member (2) and the locking rod (4) form a four-bar linkage mechanism; and wherein the locking rod (4) is rotatable between a plurality of positions, the positions comprise a plurality of locking positions, and when the locking rod (4) is in each of the locking positions, the guide rod (41) abuts against a bottom end of the guide slot (22) to prevent the supporting member (6) from moving upward.

10. The lift chair according to claim 9, wherein the first end of the rear transmission member (3) is rotatably connected with the frame (1) through a first rivet (51), the second end of the rear transmission member (3) is rotatably connected with the middle portion of the rear rotating member (2) through a second rivet (52), the upper end of the locking rod (4) is rotatably connected with the frame (1) through a third rivet (53), and axial directions of the first rivet (51), the second rivet (52) and the third rivet (53) are in parallel with one another.

11. The lift chair according to claim 10, wherein the self-locking mechanism further comprises a position limiting pin (7) fixed to the frame (1), and when the locking rod (4) is in each of the locking positions, the axial directions of the second rivet (52) and the third rivet (53) are collinear, and the rear transmission member (3) is in contact with the position limiting pin (7).

12. The lift chair according to claim 11, wherein:

the locking positions comprise a first locking position and a second locking position;

when the locking rod (4) is in the first locking position, the first rivet (51), the third rivet (53) and the guide rod (41) form a self-locking triangular structure, and the supporting member (6) is located at a front side relative to the frame (1);

when the locking rod (4) is in the second locking position, the first rivet (51), the third rivet (53) and the guide rod (41) are all aligned along a same line perpendicular to the axial directions, and the supporting member (6) is located at a back side relative to the frame (1); and when the locking rod (4) is in a position between the first locking position and the second locking position, the locking rod (4) prevents the rear rotating member (2) from moving upward, and further prevents the supporting member (6) from moving upward.

13. The lift chair according to claim 12, wherein:

the positions further comprise an unlocking position, and the second locking position is between the first locking position and the unlocking position;

when the locking rod (4) is in the unlocking position, the axial directions of the second rivet (52) and the third rivet (53) are not collinear, the rear transmission member (3) is not in contact with the position limiting pin (7), and the guide rod (41) does not abut against the bottom end of the guide slot (22), and the first rivet (51), the third rivet (53) and the guide rod (41) are not all aligned along the same line and do not form the self-locking triangular structure.

14. The lift chair according to claim 13, wherein:

the supporting member (6) is movable between a first position, a second position, a third position and a fourth position;

when the supporting member (6) is in the first position or the second position, the locking rod (4) is in the first locking position;

when the supporting member (6) is in the third position, the locking rod (4) is in the second locking position; and when the supporting member (6) is in the fourth position, the locking rod (4) is in the unlocking position.

15. The lift chair according to claim 14, further comprising a spring connecting the frame (1) and the supporting member (6), wherein when the locking rod (4) is in the unlocking position, the spring is configured to provide a downward elastic force on the supporting member (6) to prevent the supporting member (6) from moving upward.

* * * * *